United States Patent [19]

Erikson

[11] 4,010,851

[45] Mar. 8, 1977

[54] COLLAPSIBLE PAINTER'S CANVAS FRAME HOLDER RACK

[76] Inventor: Alma Doris Erikson, 328 W. 17th St., New York, N.Y. 10011

[22] Filed: Jan. 15, 1975

[21] Appl. No.: 541,159

[52] U.S. Cl. ..... 211/189; 108/60; 108/111

[51] Int. Cl.[2] ..... A47F 5/10

[58] Field of Search ..... 211/177, 184, 189; 108/60, 61, 111

[56] References Cited

UNITED STATES PATENTS

| | | | |
|---|---|---|---|
| 1,227,703 | 5/1917 | Ulrich | 108/61 |
| 1,748,339 | 2/1930 | Gerberich | 108/61 |
| 2,908,400 | 10/1959 | Richter | 108/60 |
| 2,945,732 | 7/1960 | Edmondson | 211/184 |
| 3,379,315 | 4/1968 | Broadwin | 211/177 |
| 3,495,553 | 2/1970 | McClure | 108/111 |
| 3,807,572 | 4/1974 | Luvara et al. | 108/61 |
| 3,868,123 | 2/1975 | Berg et al. | 211/177 |

*Primary Examiner*—Roy D. Frazier
*Assistant Examiner*—Darrell Marquette

[57] ABSTRACT

In a preferred embodiment, a collapsible painter's canvas frame holder rack having upper and lower sheets of plastic having slots arranged in a prescribed pattern therein for detachably mating male keys of upright support strips having each along one dimension of its thickness an elongated shape corresponding to elongated shape of the slot, and the keys being on the upper and lower ends of the strips for insertion when the strips are upright to support the upper sheet above the lower strip, with one strip at each end of the sheets positioned transversely to other support strips such that the entire structure is secure against accidental shifting, the remaining strips being positioned to define frame insertion spaces between the strips in directions substantially parallel with widths of the strips.

5 Claims, 3 Drawing Figures

COLLAPSIBLE PAINTER'S CANVAS FRAME HOLDER RACK

This invention relates to a temporary collapsible and thereby easily transportable and storable holder rack for a painter's canvas frame.

BACKGROUND TO THE INVENTION

Prior to the present invention, painters have experienced the renown difficulty of finding appropriate places and spaces and supports for canvas frames particularly during intermittent storage thereof while temporarily working on other canvases, and after completion with the painting of a canvas, with the ever present dangers of puncture of the canvas and/or the damaging of the painting on the canvas, with the result that too often the artist's environment takes on an appearance of a cluttered and disorderly work room. Also, often it is desirable to make the painted canvases readily available without having to unpile a stack thereof. There have existed racks prior to the present invention, but often such are avoided because they take up too much needed space during periods when the rack is not needed, and the excessive bulk of the rack makes its storage most inconvenient or impossible. Also, the bulk thereof eliminates the possibility of easy transport thereof to areas of display of the paintings. Also, the great mass thereof in the past has not made transport thereof an easy matter.

SUMMARY OF THE INVENTION

Objects of the present invention include the overcoming of one or more difficulties of the type discussed above.

Another object is to make possible easy assemblage of a rack kit utilizable for temporary or permanent storage of canvas frames with or without mounted and/or painted canvases.

Another object is to obtain a novel combination of rack parts which are detachably interlockable.

Another object is to obtain a novel rack collapsible into a plurality of parts which when assembled is sturdy against an accidental collapse and/or against unsteady shifting of the structure.

Another object is to obtain a collapsible rack which when disassembled comprises conveniently packed and/or stored and/or transported elements.

Another object is to obtain one or more of preceding objects while maintaining low cost of parts and production thereof.

Other objects become apparent from the preceding and following disclosure.

One or more objects of the present invention are obtained by the invention as defined herein.

Broadly the invention may be defined as a collapsible painter's canvas frame holder rack having upper and lower preferably substantially planar sheets with each sheet having a predetermined configuration of female receptacles, preferably through passages, in the lower face of the upper sheet and in the upper face of the lower sheet with the receptacles positioned in the respective upper and lower sheets in opposing relationships to one another for opposing faces when the upper sheet is positioned in substantially an aligned state with the pattern of female receptacles in the upper sheet in a substantial mirror image of and over the pattern of locations of female receptacles of the lower sheet, and a plurality of support sheets uprightly, preferably vertically, positionable between the upper and lower sheets with at least a majority of the support sheets preferably being support strips, and each support sheet having at least one of upper or lower ends thereof, and preferably at both upper and lower ends thereof male inserts shaped to detachably lock into the female receptacles of the respective upper and lower sheets. At least one of the female receptacles is elongated along a surface of its respective sheet and at a least another female receptacles thereof is elongated along an axis substantially perpendicular or at least transverse to the one elongated female receptacle, and at least two of the support sheets or strips have each at least one of the inserts thereof correspondingly elongated and shaped for substantially snugly lockably fitting into the respective elongated female receptacle therefor, whereby the support sheets or strips when mounted between the upper and lower sheets with the male inserts mated within the female receptacles are braced against shifting with the support sheets mounted uprightly extending longitudinally between the upper and lower sheets respectively. Preferably each support sheet or strip includes a male insert at each of the opposite ends of the longitudinal axis thereof for detachably locking to the respective upper and lower sheets in the female receptacles thereof. Also, in a preferred configuration for improved locking and sturdiness of support, the respective male inserts each are a continuation of its support sheet or strip continuing with and as a part of the opposite flat faces of the support sheet or strip and each defines a stepped configuration in relation to and at remaining end face surface at the top and bottom ends respectively of the support sheet and/or strip. The strips are preferably of a width sufficiently less and of predetermined dimensions such that at least two support sheets or stips may be aligned in series with one-another along width axes thereof and spaced apart from one-another predetermined distances in the series along their width axes in being mounted along a width axes of the upper and lower sheet (i.e. transversely to the longitudinal axis of the upper and lower sheets), and also preferably at least two support sheets or strips, only one being less desirable, are mounted at each of opposite ends of the respective upper and lower sheets therebetween the width axis of each sheet extending in a direction along a longitudinal axis of the upper and lower sheets to thereby form a sturdy brace with such separate support sheet or strip having an edge thereof in engagement preferably with a face of another one of the support sheets or strips thereby forming a bracing configuration. In order to facilitate ease of movement of the assembled structure of this invention, the lower face of the lower sheet includes a plurality of castors arranged to support the lower sheet, in a preferred embodiment, in a horizontal position normally.

The invention may be better understood by making reference to the following Figures.

THE FIGURES

FIG. 1 illustrates a perspective side and top view of a preferred embodiment of the present invention, with partial cutaway of the upper sheet structure for purpose of better illustration of the relationships between the sheet structure and the support sheet and strips and inserts and female receptacles.

FIG. 2 illustrates a view as taken along lines 2—2 of the FIG. 1 embodiment, with partial cut-away of the end support sheet extending along the width of the upper and lower sheet and transversely to the longitudinal axes of the upper and lower sheets, in order to better illustrate the relative positions of support strips mounted therebehind the end support sheet in parallel therewith in so far as width axes of the respective sheets and strips arranged along the longitudinal axes of the respective upper and lower sheets.

FIG. 3 illustrates a view as taken along lines 3—3 of the FIG. 1 embodiment, in an in-part view thereof.

DETAILED DESCRIPTION OF THE INVENTION

Figure 1:
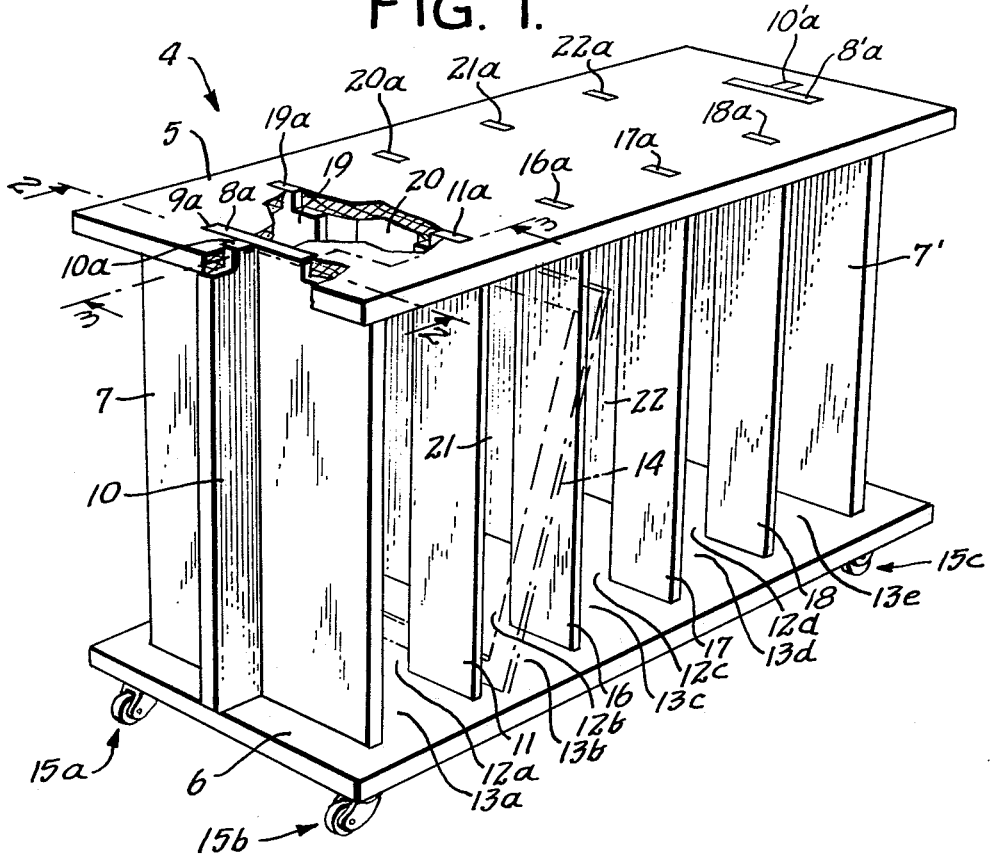
Figure 2:
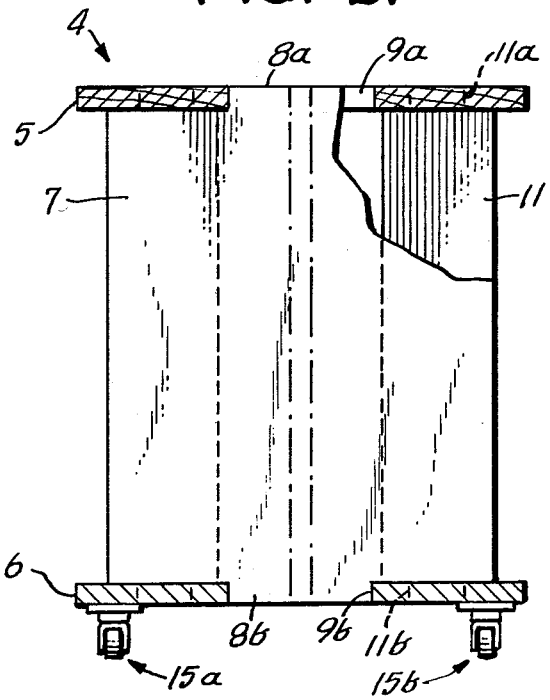
Figure 3:
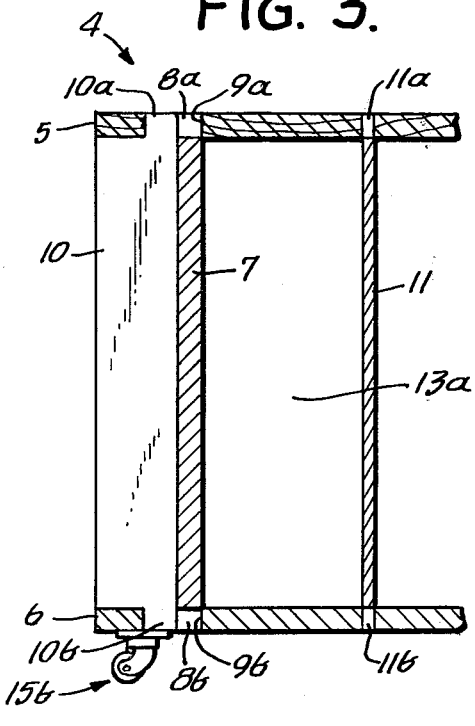

The support sheets or strips, as the case may be, are mounted between the upper surface of the lower sheet and the lower surface of the upper sheet, with the male inserts of each of opposite ends of the respective support sheets and strips detachably mated within the conforming configuration of the opposing female receptacles in the upper and lower sheets respectively, with the pattern of predetermined locations of the plurality of female receptacles in each of the upper and lower sheets being such that when the male inserts of the respective support sheets or strips are detachably locked thereto, the respective support sheets and strips are aligned with width axes thereof parallel to one-another, except for at least two separate support sheets or strips mounted at preferably each of opposite ends between the upper and lower sheets each positioned with its respective width axis extending in a direction transverse to the width axis of other support sheets or strips and preferably with an edge thereof in flush and bracing contact with a face of an adjacent end-support sheet or strip to result in a bracing support relationship thereby assuring against accidental shifting and thereby providing for sturdy structure in the mounted state. The preferred rack in the assembled state is illustrated in FIGS. 1 through 3 as rack 4 having upper and lower sheets 5 and 6 with uprightly positioned end support sheets 7 and 7' each having end inserts thereto such as sheet 7 having male insert 8*a* at an upper end thereof and male insert 8*b* at a lower end thereof as viewable in FIG. 2, mounted respectively in female receptacle 9*a* in the upper sheet and female receptacle 9*b* of the lower sheet, the inserts 8*a* and 8*b* respectively each being or defining a stepped relationship with regard to the remainder of the upper and lower end surfaces of the support sheet 7. Similarly, for the support sheet 7', in FIG. 1 there may be seen the upper end of the insert 8'*a* in its inserted state within the female receptacle therefor in the upper sheet 5. With the width axis extending in parallel relationship to the width axis of the support sheet 7, the support strip 11 is mounted behind the support sheet 7 as viewed in each of FIG. 1 and 2 and 3, and in series with the support strip 11 is the support strip 19 with the width of the support strips 11 and 19 lineally aligned and with the strips spaced apart from one-another, the axes of both being transverse to the longitudinal axes of the upper and lower sheets 5 and 6. Accordingly, there is defined between the serially arranged strips 11 and 19 a space 12*a* and there are similar spaces 12*b*, 12*c*, and 12*d* centrally adjacent each of the support strips 16, 17, and 18. The female receptacles in the upper and lower sheets are arranged in predetermined patterns such that the respective male insert such as 11*a*, 19*a*, 16*a*, 20*a*, and 17*a*, and 21*a*, and 22*a*, and 8'*a* define between flat faces of the support sheets and strips 7, 11, 16, 17, 18, 7', for example, spaces 13*a*, 13*b*, 13*c*, 13*d*, 13*e*, the FIG. 3 illustration most clearly illustrating a typical one of such spaces as 13*a* located between the support sheet 7 and the support strip 11. Within such space, such as for example is illustrated for space 13*d*, there is insertable an artist's canvas frame such as illustrated in phantom as frame 14 in FIG. 1. At each of opposite ends of the rack 4 in the assembled state, there are located a support strip such as support strip 10 at one end of the rack, having its male insert 10*a* at the top end thereof and 10*b* at the lower end thereof, and at the opposite end of the rack there is viewable upper insert 10'*a* in the inserted mated lockably detachable state.

As viewed in each of FIGS. 1 through 3, on the lower face of the lower sheet, there are mounted as typically represented in FIGS. 1–3, castors 15*a*, 15*b*, and 15*c*, for example. Not viewable would obviously be a fourth caster adjacent the remaining corner.

It is within the scope of the present invention to make such variations and modifications and substitution of equivalents as would be apparent to a person of ordinary skill.

I claim:

1. A collapsible painter's canvas frame holder rack comprising in combination: a lower sheet structure and a separate upper sheet structure, an upper face on the lower sheet structure having female receptacles some of which female receptacles are spaced along the upper surface at first predetermined intervals substantially in linear alignment along an axis extending transversely along a width of the lower sheet structure, and spaced apart at second predetermined intervals along a longitudinal axis of the lower sheet structure, the upper sheet structure having female receptacles on a lower face thereof positioned substantially as a mirror image of the upper face of the lower sheet structure such that when the upper sheet structure is positioned with its lower face in substantial alignment over the upper face of the lower sheet structure said female receptacles of the upper sheet structure are in substantially opposing relationships to one-another spaced-apart from one-another, and a plurality of at least three upright support sheets extending substantially parallel to one-another and said support sheets including opposite end support sheets and at least one intermediate upright support sheet all having each of opposite upper and lower ends shaped to define male inserts shaped to detachably lock into the female receptacles of the upper sheet structure and the lower sheet structure respectively at least first ones of the other of said female receptacles being located on each of said lower and upper sheet structures and being elongated along other transverse axes thereof and at least second ones of the other of said female receptacles being located on each of said sheet structures and being elongated along another longitudinal axis and intersecting said first ones of said female receptacles at substantially right angles thereto, and at least the two support sheets of the opposite ends each having its male insert at both ends thereof elongated along a linear axis of a width of the respective upper and lower sheet structures and received within said first ones of said female receptacles, a pair of support strips having a male insert at each of the ends thereof mounted within said second ones of said female receptacles, said support strips extending at right angles to and engaging the respective ones of said two support sheets at the opposite ends, whereby said plurality of sheet structures are braced against shifting with the support sheets mounted uprightly with their respective longitudinal axes extending between the upper and lower sheet structures respectively, and whereby a plurality of side-by-side support channels defining through-spaces are formed between the at least three parallel upright support sheets.

2. A collapsible painter's canvas frame holder rack of claim 1, in which each of the male inserts of each of opposite ends of each of the plurality of support sheets are elongated along the axis of width of the respective support sheet.

3. A collapsible painter's canvas frame holder rack of claim 2, in which each male insert is a continuation of the support sheet and in which at least some of the male inserts define a stepped relationship at upper and lower ends of the respective support sheet.

4. A collapsible painter's canvas frame holder rack of claim 3, in which along axes transverse to widths of the upper and lower sheet structures respectively at least two intermediate support sheets are placed one in series with the other along width axes thereof spaced-apart from one-another.

5. A collapsible painter's canvas frame holder rack of claim 4, and castor means for providing rolling movement mounted on a lower surface of the lower sheet structure supportably.

* * * * *